US011585162B2

(12) United States Patent
Tunkiel et al.

(10) Patent No.: US 11,585,162 B2
(45) Date of Patent: Feb. 21, 2023

(54) SYSTEM AND METHOD FOR MAKING A THREADED CONNECTION

(71) Applicant: Nabors Lux 2 SARL, Luxembourg (LU)

(72) Inventors: Andrzej Tunkiel, Sandnes (NO); Siamak Sand, Stavanger (NO); Lukasz Zeprzalka, Sandnes (NO)

(73) Assignee: NABORS LUX 2 SARL, Luxembourg (LU)

( * ) Notice: Subject to any disclaimer, the term of this patent is extended or adjusted under 35 U.S.C. 154(b) by 1112 days.

(21) Appl. No.: 16/180,991

(22) Filed: Nov. 5, 2018

(65) Prior Publication Data

US 2019/0162031 A1 May 30, 2019

Related U.S. Application Data

(60) Provisional application No. 62/592,069, filed on Nov. 29, 2017.

(51) Int. Cl.

| | |
|---|---|
| ***E21B 17/042*** | (2006.01) |
| *F16L 15/08* | (2006.01) |
| *F16L 37/113* | (2006.01) |
| *F16L 37/252* | (2006.01) |

(52) U.S. Cl.

CPC ..... *E21B 17/042* (2013.01)

(58) Field of Classification Search

None

See application file for complete search history.

(56) References Cited

U.S. PATENT DOCUMENTS

| | | | | |
|---|---|---|---|---|
| 1,969,142 A * | 8/1934 | McIntyre | F16L 19/14 | 411/270 |
| 2,470,546 A * | 5/1949 | Carlson | F16L 19/12 | 29/520 |
| 3,733,853 A * | 5/1973 | Sutliff | E21B 17/20 | 464/158 |
| 4,836,306 A * | 6/1989 | Barrows | E21B 17/043 | 279/127 |
| 4,953,640 A * | 9/1990 | Kurt | F16D 1/06 | 285/308 |
| 5,135,029 A * | 8/1992 | Anderson | F16L 35/00 | 137/614.04 |

(Continued)

*Primary Examiner* — Matthew Troutman
*Assistant Examiner* — Douglas S Wood
(74) *Attorney, Agent, or Firm* — Ewing & Jones, PLLC

(57) ABSTRACT

A system for connecting a male component to a female component comprises a male component comprising a main body including a first compression face, a first tension face, and an outer surface that includes a plurality of first longitudinal splines; a middle element including an inner surface, an outer surface, and a second tension face configured to engage the first tension face, the inner surface including a plurality of second longitudinal splines corresponding to and engaging the first longitudinal splines so as to form a splined interface and the outer surface including a threaded section; and a female component defining a box, the box including a second compression face for engaging the first compression face and an inner wall that includes a wall threaded section corresponding to and engaging the middle element threaded section. The middle element may comprise a plurality of azimuthal segments.

17 Claims, 5 Drawing Sheets

(56) References Cited

U.S. PATENT DOCUMENTS

| | | | | |
|---|---|---|---|---|
| 5,165,492 | A | 11/1992 | Beasley | |
| 5,411,301 | A | 5/1995 | Moyer et al. | |
| 5,474,334 | A | 12/1995 | Eppink | |
| 5,895,079 | A | 4/1999 | Carstensen et al. | |
| 5,931,511 | A | 8/1999 | Delange et al. | |
| 6,012,523 | A | 1/2000 | Campbell et al. | |
| 6,447,021 | B1 | 9/2002 | Haynes | |
| 6,607,220 | B2 | 8/2003 | Sivley, IV | |
| 6,749,026 | B2 | 6/2004 | Smith et al. | |
| 6,761,574 | B1 * | 7/2004 | Song | E21B 17/028 439/320 |
| 7,104,345 | B2 * | 9/2006 | Eppink | E21B 17/10 175/320 |
| 7,392,850 | B2 * | 7/2008 | Boyd | E21B 17/025 166/385 |
| 8,672,366 | B2 * | 3/2014 | Mogedal | F16L 19/025 285/323 |
| 2014/0124220 | A1 * | 5/2014 | Stautzenberger | E21B 34/14 175/320 |

* cited by examiner

SYSTEM AND METHOD FOR MAKING A THREADED CONNECTION

CROSS-REFERENCE TO RELATED APPLICATIONS

This application is a non-provisional application which claims priority from U.S. provisional application No. 62/592,069, filed Nov. 29, 2017, which is incorporated by reference herein in its entirety.

TECHNICAL FIELD/FIELD OF THE DISCLOSURE

The present disclosure relates to a connection for supporting a downhole tool.

BACKGROUND OF THE DISCLOSURE

Threaded connections are commonly used for connecting tubular components used in the production of hydrocarbons. One type of threaded connection connects a threaded male pin to a threaded female box. In many instances, in addition to being durable, such threaded connections need to be able to withstand axial tensile and compression forces, torque, and inward and outward pressure differentials.

In instances where a rotary steerable tool is used, the tool may include various steering-related equipment surrounding a main shaft. The main shaft rotates within tool and transmits torque from the drill string above the tool to the drill bit below the tool. System optimization requires balancing the strength of the shaft and its ability to transmit torque against a desire to maximize the volume available for the steering-related equipment surrounding the shaft. Often, the torque-transmitting capacity of a threaded connection may be limited by the material and configuration of the threads, which may, for example, fail by thread stripping. Splines are an alternative connection type and are effective for transferring torque, but splines alone cannot transfer axial loads.

SUMMARY

According to some embodiments, a system for connecting a male component to a female component may comprise a male component comprising a main body including a first compression face, a first tension face, and an outer surface that includes a plurality of first longitudinal splines; a middle element including an inner surface, an outer surface, and a second tension face configured to engage the first tension face, the inner surface including a plurality of second longitudinal splines corresponding to and engaging the first longitudinal splines so as to form a splined interface and the outer surface including a threaded section; and a female component defining a box, the box having a second compression face and an inner wall that includes a wall threaded section corresponding to and engaging the middle element threaded section.

According to other embodiments, a system for connecting downhole tools may comprise a male component comprising a main body having a central bore therethrough and including a first compression face, a first tension face, and an outer surface that includes a plurality of first longitudinal splines; a middle element including a central bore therethrough and having an inner surface, an outer surface, and a second tension face configured to engage the first tension face, the inner surface including a plurality of second longitudinal splines corresponding to and engaging the first longitudinal splines so as to form a splined interface and the outer surface including a threaded section; and a female component including a central bore therethrough and defining a box, the box having a second compression face and an inner wall that includes a wall threaded section corresponding to and engaging the middle element threaded section.

According to some embodiments, the male component has a first diameter, the female component has a second diameter that is greater than the first diameter, no part of the male component has a diameter greater than the first diameter, and the outer surface of the middle element has a diameter greater than the first diameter.

The middle element may be substantially annular and may comprise a plurality of azimuthal segments. The second compression face may engage the first compression face.

The middle element may comprise an end cap that includes third and fourth compression faces. The third compression face may engage the first compression face, the fourth compression face may engage the second compression face, the first and second tension faces may each be threaded, and the end cap may be threaded onto the outer surface of the male component.

In some embodiments, the outer surface of the middle element may have a diameter greater than the diameter of the main body of the male component. The middle element may further include a flange extending radially therefrom and the flange may have a diameter greater than the diameter of the box.

The male component, female component, and middle element may be configured such that tightening the threaded engagement between the middle element and the female component to a predetermined torque causes the male component to be captured between the middle element and the female component such that the first compression face bears on the second compression face and the first tension face bears on the second tension face. The male component, female component, and middle element may each have a central bore therethrough.

The male component may include at least a first outer stabilization surface and the middle element inner surface may further include at least a first inner stabilizing surface configured to bear on the first outer stabilization surface of the male component, thereby forming a first stabilizing interface. The male component may still further include a second outer stabilization surface and the middle element inner surface may still further include a second inner stabilizing surface configured to bear on the second outer stabilization surface of the male component, thereby forming a second stabilizing interface, and the splined interface may be between the first and second stabilizing interfaces. Still further, the female component may further include at least a first inward stabilization surface and the middle element outer surface may further include at least a first outward stabilizing surface configured to bear on the first inward stabilization surface of the female component, thereby forming a third stabilizing interface. The female component may still further include a second inward stabilization surface and the middle element inner surface may still further include a second outward stabilizing surface configured to bear on the second inward stabilization surface of the female component, thereby forming a fourth stabilizing interface, and the middle element threaded section may be between the third and fourth stabilizing interfaces.

The middle element may comprise a first section including at least the second tension face and a second section including the second longitudinal splines and the middle element threaded section. The first section may be provided as a plurality of azimuthal segments and the second section may be substantially annular.

The middle element may comprise a first section including at least the second tension face and a second section including the second longitudinal splines and the middle element threaded section. The first section may be provided as a plurality of azimuthal segments and the second section may be substantially annular.

In still other embodiments, the middle element may comprise an end cap that includes third and fourth compression faces. The third compression face may engage the first compression face, the fourth compression face may engage the second compression face, the first and second tension faces may each be threaded, and the end cap may be threaded onto the outer surface of the male component.

For clarity, unless otherwise indicated, as used herein the word "torque" refers to a rotational force about the longitudinal axis of the system, also referred to as the tool axis. Similarly, a mechanical engagement between two components may be described in terms of its ability to transfer torque or force from one component to another; it will be understood that the direction of the transfer is not limited by the order of the recitation of components.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
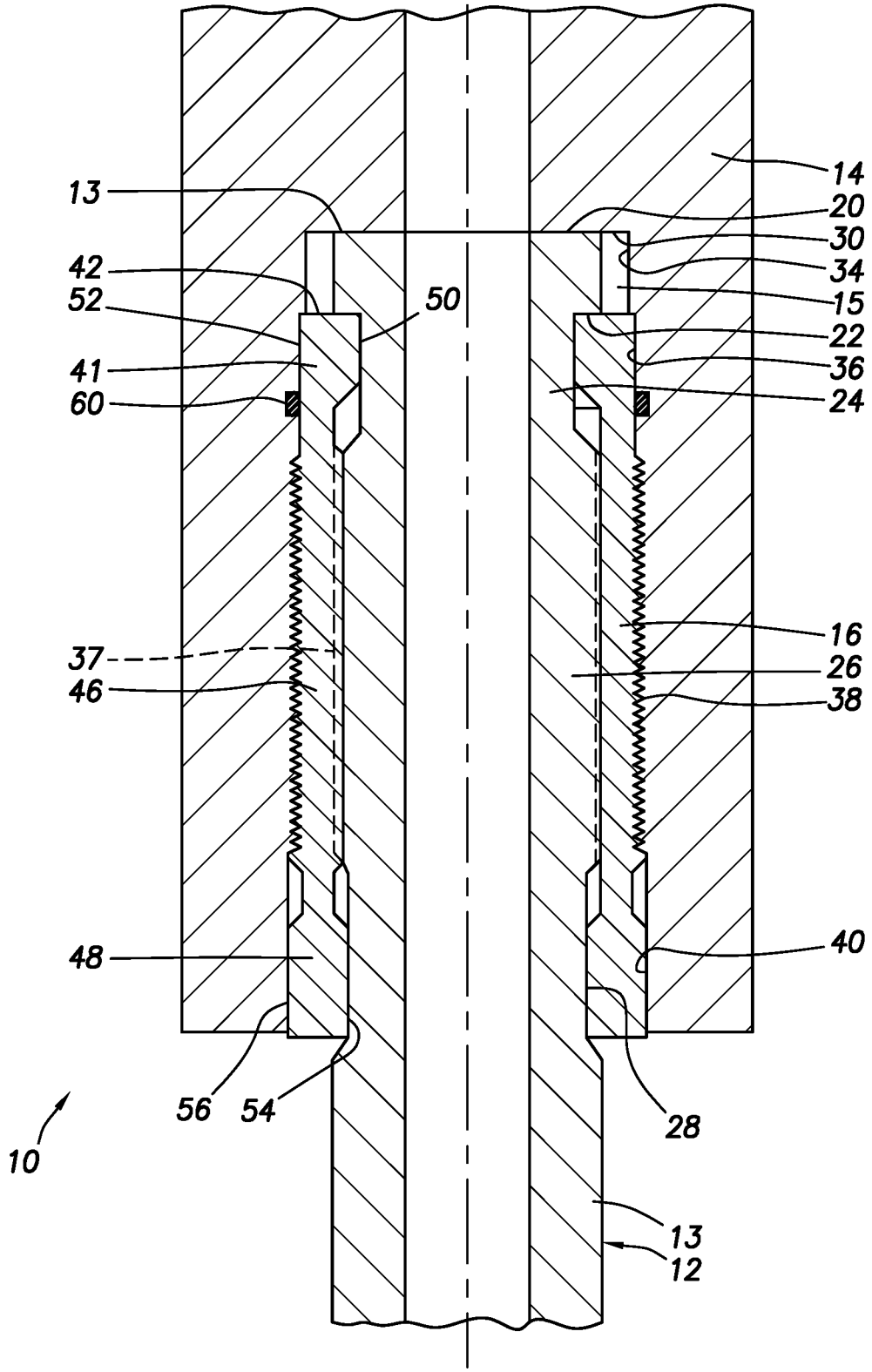
FIG. 1 is a schematic cross-section showing a device in accordance with some embodiments.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Referring initially to FIG. 1, a system 10 in accordance with some embodiments includes a male component 12, a female component 14, and an annular middle element 16. Each of male component 12, female component 14, and middle element 16 may include a central bore therethrough, such that when the system is assembled, the bores form a continuous fluid channel through the assembly. If the present invention is used to connect downhole tools in a drilling environment, the fluid channel may be used for the passage of mud, slurry, gas, or other fluids related to the production of hydrocarbons. In other embodiments, one or more of the system components may have no central bore.

Male component 12 may include a main body 13, a compression shoulder 20, a tension shoulder 22, a first neck 24, a spline section 26, and a second neck 28. In some embodiments, the diameter of compression shoulder 20, spline section 26, and tension shoulder 22 are each substantially the same as or somewhat less than the diameter of main body 13. The diameter of each neck 24, 28 may be less than the diameter of spline section 26. Female component 14 may include a box 15 defined by a compression face 30 at its inner end and a sidewall 34. Sidewall 34 may include a first stabilization section 36, a threaded section 38, and a second stabilization section 40.

Middle element 16 may include a first stabilizing section 41, a spline section 46, and a second stabilizing section 48. The end of first stabilizing section 41 defines a tension face 42 that may be substantially normal to the central bore. At first stabilizing section 41, the inner and outer surfaces of middle element 16 may define first inner and outer stabilizing surfaces 50, 52, respectively. Likewise, at second stabilizing section 48, the inner and outer surfaces of middle element 16 may define second inner and outer stabilizing surfaces 54, 56, respectively. The outer surface of spline section 46 of middle element 16 may include threads configured to engage the threaded section 38 of female component 14. In some embodiments, first and second stabilizing sections 41, 48 are at opposite ends of middle element 16 and spline section 46 is between them.

The outer surface of spline section 26 of male component 12 and the inner surface of spline section 46 of middle element 16 may each include a plurality of longitudinally extending splines (shown in phantom at 37) configured so that the splines on male component 12 engage with the splines on middle element 16. The engagement of the splines prevents rotation of male component 12 relative to middle element 16 and allows the transmission of torque therebetween.

Middle element 16 may be formed in two or more parts, which may be substantially identical. More specifically, annular middle element 16 may be divided longitudinally into two or more azimuthal segments. The segments may or may not define a complete circle.

When it is desired to assemble an apparatus in accordance with some embodiments, the two or more segments of middle element 16 are assembled around male component 12. The segments of middle element 16 may be positioned longitudinally relative to male component 12 so that first and second stabilizing sections 41, 48 align longitudinally with first and second necks 24, 28, respectively, of male component 12 and may be positioned azimuthally relative to male component 12 so that the splines on male component 12 and middle element 16 interleave. In some embodiments, middle element 16 is not restrained from moving longitudinally relative to male component 12 at this point.

The assembly comprising male component 12 and middle element 16 may then be aligned with box 15 of female component 14. Rotation of female component relative to the assembly will result in engagement of the outer threads of middle element 16 with the internal threads of threaded section 38 of box 15. Male component 12, female component 14, and middle element 16 may be configured such that when the threaded engagement is tightened to a predetermined torque, the end of male component 12 is captured between middle element 16 and female component 14 such that compression shoulder 20 bears on compression face 30 and tension shoulder 22 bears on tension face 42, thereby limiting the extent to which middle element 16 can advance into female component 14. At this point, further movement of middle element 16 relative to female component 14 is prevented and the application of further torque in the same direction will result in an additional load at the interface between compression shoulder 20 and compression face 30.

When all the parts are threaded together, middle element 16 may be compressed by the threading action tightening the fit on the splined connection, removing some, or all slack in the splines. This reduces or removes any chatter in the spline section, which in turn reduces wear on the components.

Figure 2:
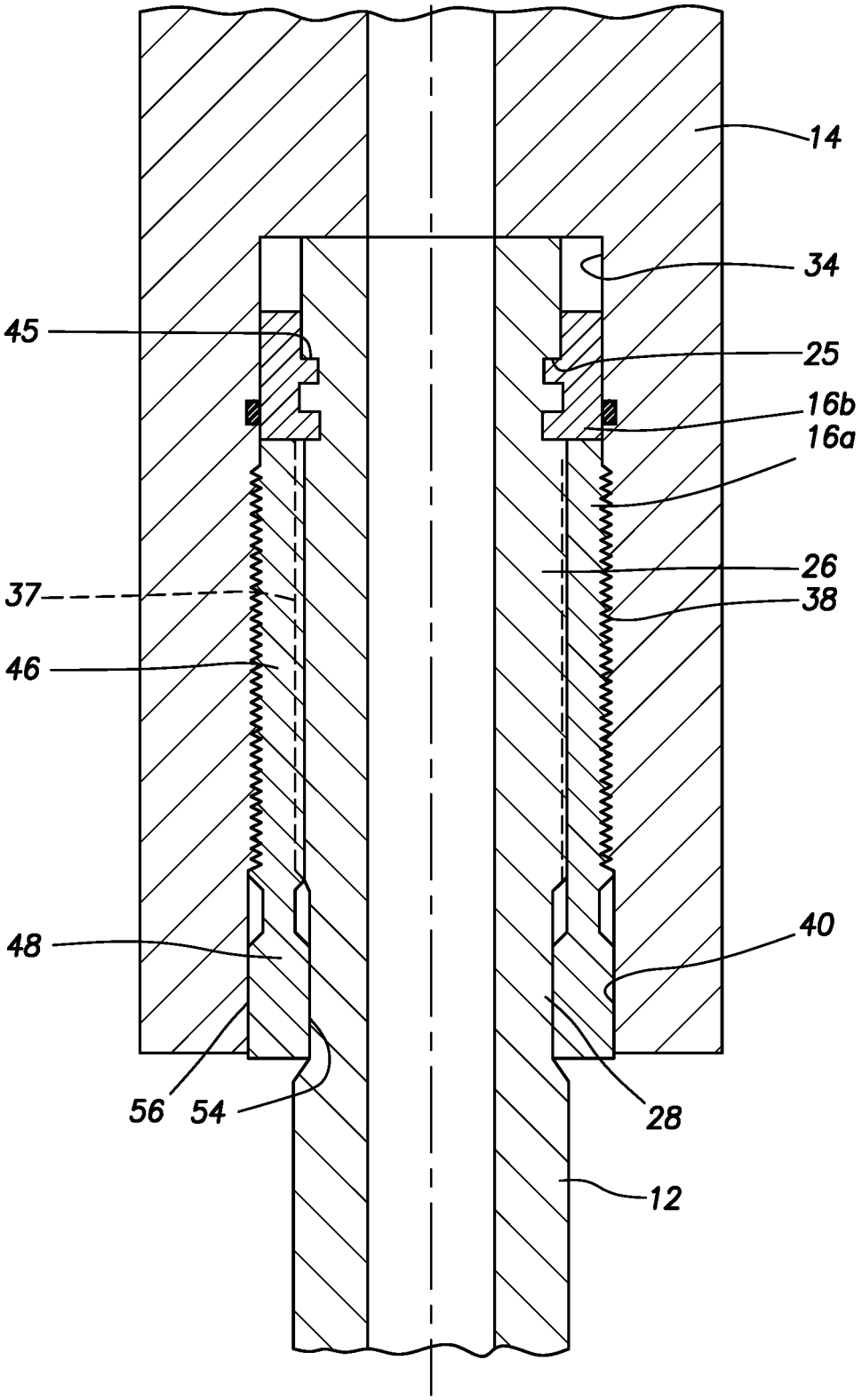
FIG. 2 is a schematic cross-section showing a device in accordance with other embodiments.
Figure 2A:
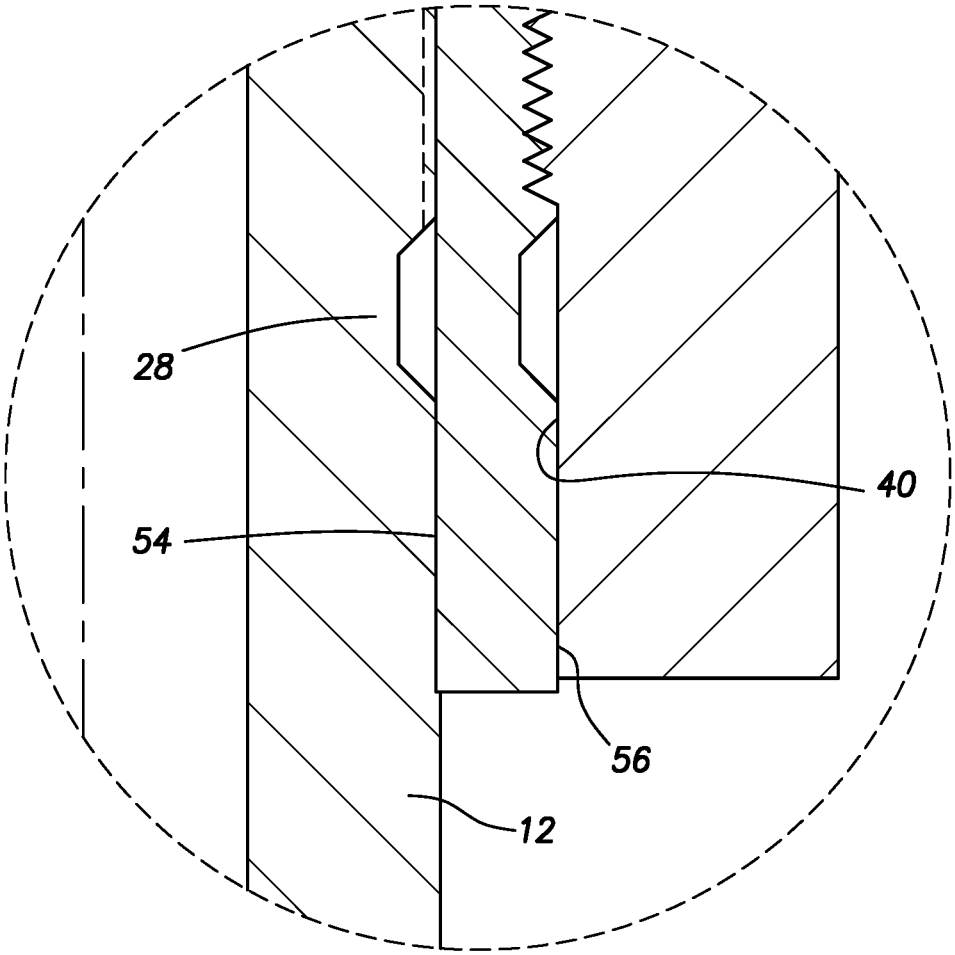
FIG. 2A is a view of a portion of FIG. 2 showing an alternative embodiment.

As mentioned above, in some embodiments, each end of middle element 16 includes inner and outer stabilizing surfaces, numbered 50, 54 and 52, 56, respectively. The stabilizing surfaces are configured to mate tightly against corresponding surfaces on the male and the female parts when the components are assembled and tightened together. In some embodiments, inner stabilizing surfaces 50, 54 may bear on necks 24, 28, respectively and outer stabilizing surfaces 52, 56 may bear on side wall 34. In other embodiments, one or both of necks 24, 28 may be configured such that one or both of inner stabilizing surfaces 50, 54 may not bear on necks 24, 28, respectively, as illustrated at FIG. 2A.

In the embodiment of FIG. 1, torque applied to system 10 is transferred between middle element 16 and male component 12 by the splined connection, tension loads applied to system 10 are transferred between middle element 16 and male component 12 via tension shoulder 22 and tension face 42, both torque and tension loads are transferred between middle element 16 and female component 14 by means of threads 38, bending moment is transferred substantially through the multiple stabilizing surfaces, and compression loads applied to system 10 are transferred directly between male component 12 and female component 14 by means of compression shoulder 20 and compression face 30.

In some embodiments, one or more seals 60 may be provided between middle element 16 and sidewall 34 of box 15 so as to prevent fluid passage therebetween and to isolate the threads from the environment. In some embodiments, additional seals may be included at various points. By way of example only, a seal may be provided between stabilizing surface 56 and sidewall 34 to further seal the threads from the environment. Likewise, a seal may be provided between either or both of stabilizing surfaces 50, 54 and necks 24, 28, respectively, so as to isolate the splined interface from the environment. Alternatively or in addition, a seal could be placed between compression shoulder 20 and compression face 30. One skilled in the art will recognize that the placement of seals is a matter of design.

As mentioned above, it is not necessary that middle element 16 be a single piece. Referring briefly to FIG. 2, in an alternative embodiment, middle element 16 could be provided as first and second elements 16*a*, 16*b*, respectively, each of which may itself comprise one or more pieces. In this embodiment, first middle element 16*a* may include inner splines and outer threads, as in the embodiment described above. Second middle element may include at least one tension face 45, which receives a corresponding tension shoulder 25 on male component 12. In this embodiment, first middle element 16*a* may or may not be provided as a single piece that slides onto male component 12, thereby engaging the splines, while second middle element 16*b* may be provided as a split ring comprising two more segments. In the embodiment of FIG. 2, loads are transferred substantially as described above with respect to FIG. 1.

Figure 3:
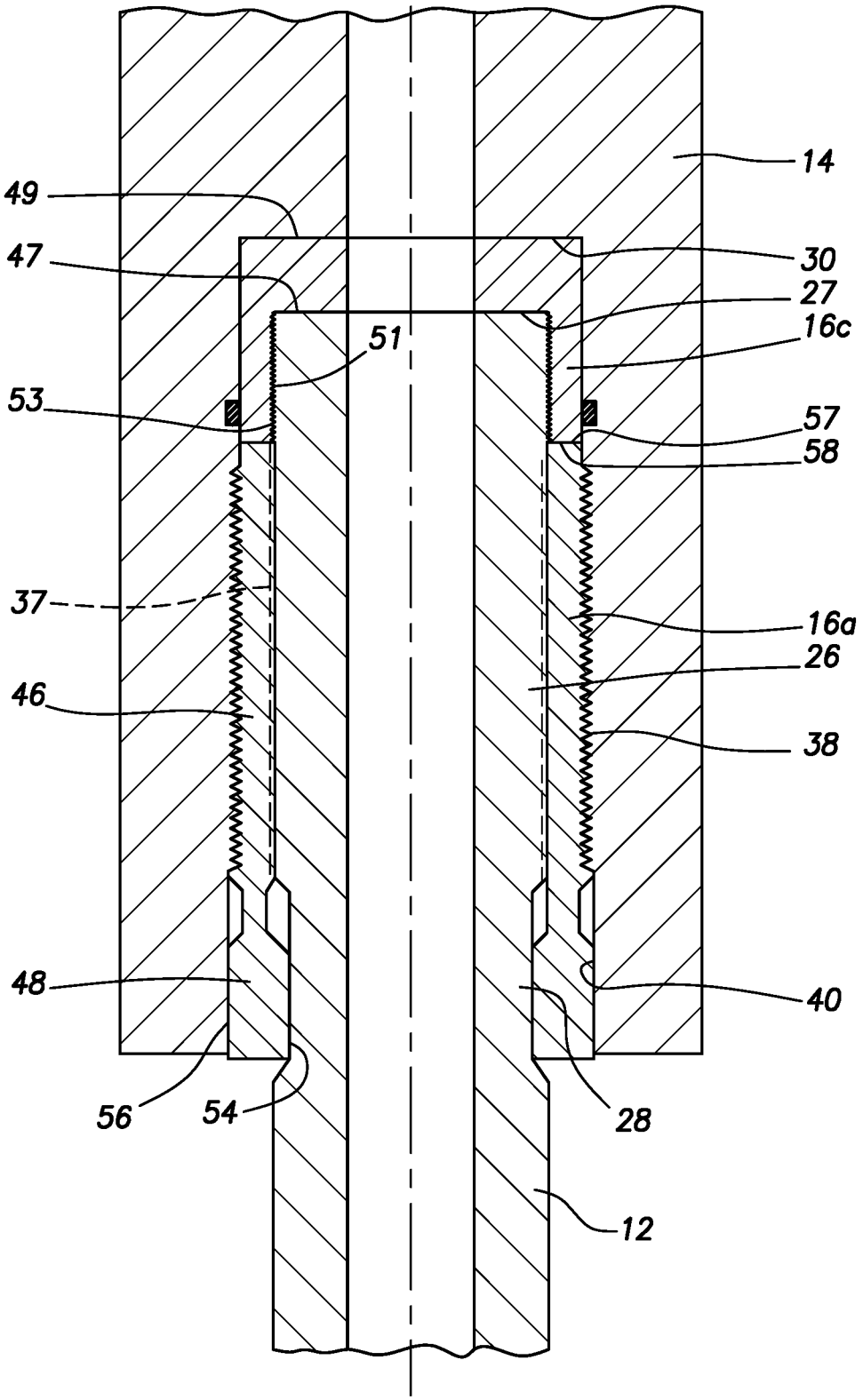
FIG. 3 is a schematic cross-section showing a device in accordance with other embodiments.

Referring now to FIG. 3, in other embodiments, the second middle element may be provided as a cap 16*c* that includes an outer end surface 49, an inner end surface 27, a tension load face 58, and a threaded inner wall 51. First middle element 16*a* includes an end face 57. In this embodiment, male component 12 includes an end face 47 and an outer threaded section 53. In this embodiment, compression loads applied to system 10 may be transferred through cap 16*c* via end face 47 and outer end surface 49, which bear on inner end surface 27 and compression face 30, respectively. Instead of transmitting tension loads via a tension shoulder 22 and corresponding tension face 42 as above, in this embodiment, tension loads may be transferred male component 12 and cap 16*c* at the tension interface defined by threads 51, 53 and from cap 16*c* to first middle element 16*a* via tension load face 58, which bears on end face 57 thereof. As above, torque applied to system 10 may be transferred between male component 12 and first middle element 16*a* via splines 37 and both torque and tension loads are transferred between first middle element 16*a* and female component 14 via threads 38.

Figure 4:
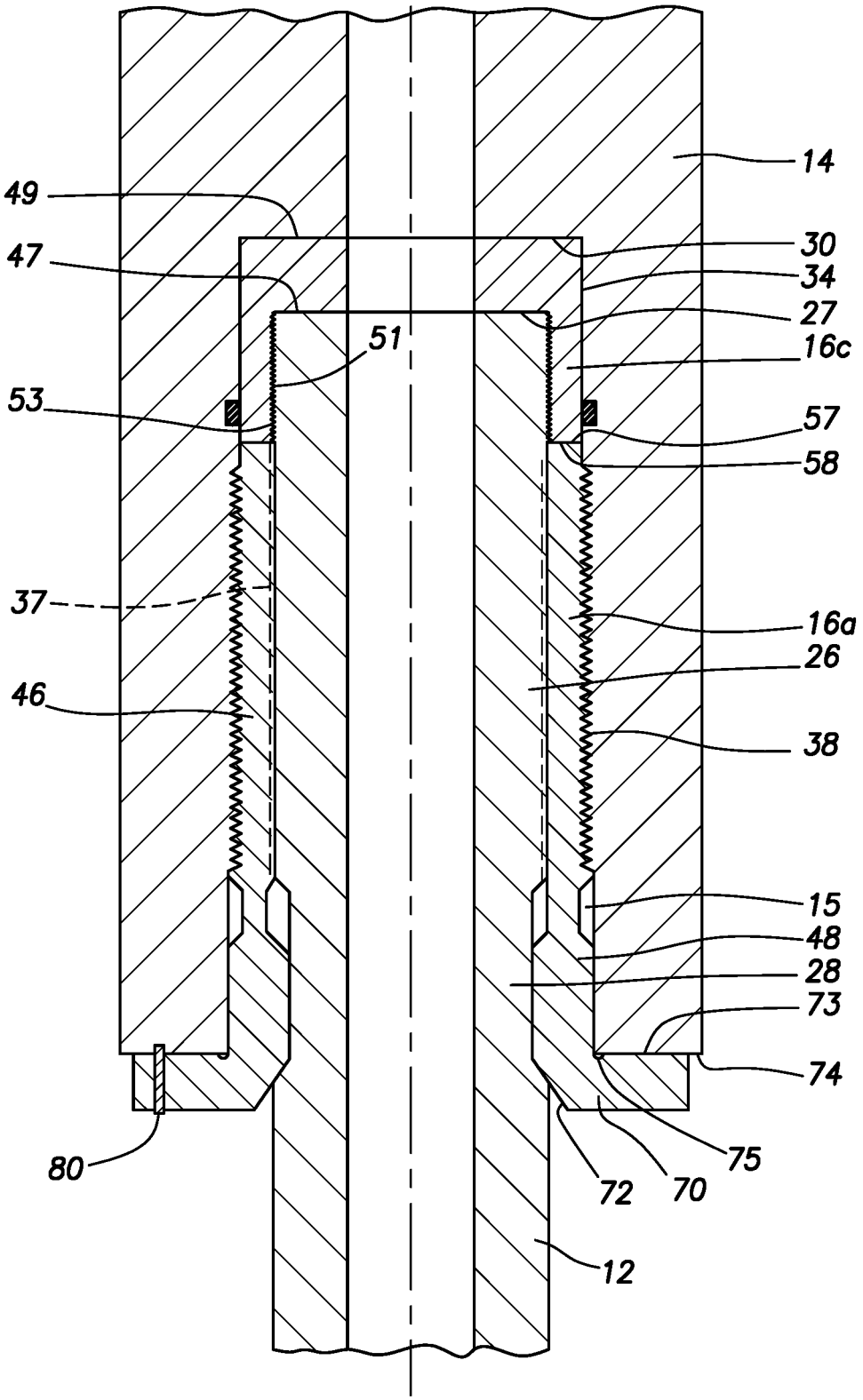
FIG. 4 is a schematic cross-section showing a device in accordance with still further embodiments.

Referring now to FIG. 4, in other embodiments, first middle element 16*a* may extend beyond the end of box 15 of female component 14. In these embodiments, a flange 70 extends radially outward from second stabilizing section 48. Flange 70 may include a chamfer 72 that corresponds to and may engage an outer surface of second neck 28 and a flange face 73 that engages end face 74 of female component 14. Flange 70 may or may not extend to the full radius of female component 14. In order to avoid stress concentrations, a stress relief groove or undercut 75 may be provided at the corner between second stabilizing section 48 and flange 70.

As in the embodiments above, middle element 16 is configured such that when the tool components 12, 14, and 16 are assembled and the threaded connection between middle element 16 and female component 14 is tightened, engagement between flange compression face 73 and end face 74 will limit the extent to which middle element 16 can advance into female component 14. At this point, further movement of middle element 16 relative to female component 14 is prevented and the application of further torque will result in an additional load at the flange interface 73, 74 and on threads 38.

In these embodiments, compression loads may be transferred through cap 16*c* via end face 47 and outer end face 49, which bear on inner end surface 27 and compression face 30, respectively. As above, tension loads may be transferred between male component 12 and cap 16*c* via threads 51, 53 and from cap 16*c* to first middle element 16*a* via tension load face 58, which bears on end face 57 thereof. Also as above, torque may be transferred between male component 12 to middle element 16 via splines 37 and both torque and tension loads are transferred between first middle element 16*a* and female component 14 via threads 38. In these embodiments, when the tool experiences a compression load, the interface between flange compression face 73 and end face 74 may take some of that load, thereby reducing the load on the interface between outer end face 49 and compression face 30.

As shown in phantom on the left side of FIG. 4, in some embodiments, one or more set screws 80 may extend through flange 70 and into the end of female component 14. If present, set screws 80 may increase the break-up torque of the assembly.

Referring to the various embodiments, once the components have been assembled, the result is a robust connection capable of transferring torque, bending moment, and axial loads. The effective diameter of the threaded connection between female component 14 and middle element 16 is greater than the diameter of the male part and can therefore accommodate a larger thread, which in turn allows higher force ratings for the transfer of torque and tension loads.

The embodiments allow a stronger joint that uses relatively few parts. Because the middle element positively engages the male and female components when the assembly is tightened, slack or play in the apparatus can be eliminated. By providing a middle element that is relatively small and can be made out of a different material than the other components if desired, it is possible to construct a tool in which the middle element is replaceable and may be sacrificial, thereby reducing the frequency at which the adjacent components need to be replaced and thereby reducing costs.

If present, stabilizing surfaces 50, 54 and 52, serve to strengthen the connection and to transfer bending moment between the male and female components without causing excessive stress on the splines and threads.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A system for connecting a male component to a female component, comprising:

a male component comprising a main body including a first compression face, a first tension face, and an outer surface that includes a plurality of first longitudinal splines;

a middle element including an inner surface, an outer surface, and a second tension face configured to engage the first tension face, wherein the inner surface includes a plurality of second longitudinal splines corresponding to and engaging the first longitudinal splines so as to form a splined interface at which the first longitudinal splines engage the second longitudinal splines so as to prevent rotation of the male component relative to the middle element so as to allow the transmission of torque therebetween, and wherein the outer surface includes a threaded section; and a female component defining a box, the box having a diameter and including a second compression face and an inner wall, wherein the inner wall includes a wall threaded section corresponding to and engaging the middle element threaded section;

wherein the male component further includes at least a first outer stabilization surface and the middle element inner surface further includes at least a first inner stabilizing surface configured to bear on the first outer stabilization surface of the male component, thereby forming a first stabilizing interface; and wherein the male component further includes a second outer stabilization surface and the middle element inner surface further includes a second inner stabilizing surface configured to bear on the second outer stabilization surface of the male component, thereby forming a second stabilizing interface, and wherein the splined interface is between the first and second stabilizing interfaces.

2. The system of claim 1 wherein the male component has a first diameter, wherein no part of the male component has a diameter greater than the first diameter, and wherein the outer surface of the middle element has a diameter greater than the first diameter.

3. The system of claim 1 wherein the second compression face engages the first compression face.

4. The system of claim 1 wherein the middle element comprises an end cap that includes third and fourth compression faces, wherein the third compression face engages the first compression face, wherein the fourth compression face engages the second compression face, wherein the first and second tension faces are each threaded, and wherein the end cap is threaded onto the outer surface of the male component.

5. The system of claim 1 wherein the middle element further includes a flange extending radially therefrom and wherein the flange has a diameter greater than the diameter of the box.

6. The system of claim 1 wherein the male component, female component, and middle element are configured such that tightening the threaded engagement between the middle element and the female component to a predetermined torque causes the male component to be captured between the middle element and the female component such that the first compression face bears on the second compression face and the first tension face bears on the second tension face.

7. The system of claim 1 wherein the male component, female component, and middle element each have a central bore therethrough.

8. The system of claim 1 wherein the female component further includes at least a first inward stabilization surface and the middle element outer surface further includes at least a first outward stabilizing surface configured to bear on the first inward stabilization surface of the female component, thereby forming a third stabilizing interface.

9. The system of claim 8 wherein the female component further includes a second inward stabilization surface and the middle element inner surface further includes a second outward stabilizing surface configured to bear on the second inward stabilization surface of the female component, thereby forming a fourth stabilizing interface, and wherein the middle element threaded section is between the third and fourth stabilizing interfaces.

10. The system of claim 1 wherein the middle element comprises a first section including at least the second tension face and a second section including the second longitudinal splines and the middle element threaded section.

11. The system of claim 10 wherein the first section is provided as a plurality of azimuthal segments and the second section is provided as an annular piece.

12. A system for connecting downhole tools, comprising:

a male component comprising a main body having a central bore therethrough and including a first compression face, a first tension face, and an outer surface that includes a plurality of first longitudinal splines;

a middle element having a central bore therethrough and including an inner surface, an outer surface, and a second tension face configured to engage the first tension face, the inner surface including a plurality of second longitudinal splines corresponding to and engaging the first longitudinal splines so as to form a splined interface at which the first longitudinal splines engage the second longitudinal splines so as to prevent rotation of the male component relative to the middle element and so as to allow the transmission of torque therebetween, and the outer surface including a threaded section; and a female component having a central bore therethrough and defining a box, the box having a diameter and including a second compression face and an inner wall, wherein the inner wall includes a wall threaded section corresponding to and engaging the middle element threaded section;

wherein the male component further includes at least a first outer stabilization surface and the middle element inner surface further includes at least a first inner stabilizing surface configured to bear on the first outer stabilization surface of the male component, thereby forming a first stabilizing interface; and wherein the male component further includes a second outer stabilization surface and the middle element inner surface further includes a second inner stabilizing surface configured to bear on the second outer stabilization surface of the male component, thereby forming a second stabilizing interface, and wherein the splined interface is between the first and second stabilizing interfaces.

13. The system of claim 12 wherein no part of the male component has a diameter greater than the main body and wherein the outer surface of the middle element has a diameter greater than the main body of the male component.

14. The system of claim 12 wherein the middle element is substantially annular and is provided as a plurality of azimuthal segments.

15. The system of claim 12 wherein the middle element comprises an end cap that includes third and fourth compression faces, wherein the third compression face engages the first compression face, wherein the fourth compression face engages the second compression face, wherein the first and second tension faces are each threaded, and wherein the end cap is threaded onto the outer surface of the male component.

16. The system of claim 12 wherein the middle element further includes a flange extending radially therefrom and wherein the flange has a diameter greater than the diameter of the box.

17. The system of claim 12 wherein the male component, female component, and middle element are configured such that tightening the threaded engagement between the middle element and the female component to a predetermined torque causes the male component to be captured between the middle element and the female component such that the first compression face bears on the second compression face and the first tension face bears on the second tension face.

* * * * *